US005917410A

United States Patent [19]

Cecic et al.

[11] Patent Number: 5,917,410

[45] Date of Patent: Jun. 29, 1999

[54] GLASS BREAK SENSOR

[75] Inventors: Dennis Cecic; Hartwell Fong, both of Scarborough, Canada

[73] Assignee: Digital Security Controls Ltd., Downsview, Canada

[21] Appl. No.: 08/645,065

[22] Filed: May 13, 1996

Related U.S. Application Data

[63] Continuation-in-part of application No. 08/522,716, Sep. 1, 1995, Pat. No. 5,675,320, which is a continuation-in-part of application No. PCT/CA95/00122, Mar. 3, 1995.

[51] Int. Cl.[6] ..... G08B 13/00

[52] U.S. Cl. ..... 340/541; 340/566

[58] Field of Search ..... 340/541, 550, 340/566; 381/56; 367/136; 364/728.07

[56] References Cited

U.S. PATENT DOCUMENTS

| | | | |
|---|---|---|---|
| 4,054,867 | 10/1977 | Owens | 340/550 |
| 4,668,941 | 5/1987 | Davenport et al. | 340/550 |
| 4,952,931 | 8/1990 | Serageldin et al. | 340/902 |
| 5,117,220 | 5/1992 | Marino et al. | 340/550 |
| 5,510,765 | 4/1996 | Madau | 340/541 |
| 5,510,767 | 4/1996 | Smith | 340/566 |
| 5,543,783 | 8/1996 | Clark et al. | 340/550 |
| 5,608,377 | 3/1997 | Zhevlev et al. | 340/566 X |
| 5,675,320 | 10/1997 | Cecic et al. | 340/566 |

FOREIGN PATENT DOCUMENTS

| | | |
|---|---|---|
| 0233390 | 8/1987 | European Pat. Off. . |
| 2284668 | 6/1995 | United Kingdom . |

*Primary Examiner*—Thomas J. Mullen, Jr.

[57] ABSTRACT

The glass break detector uses sampling techniques to a low band and a high band portion of a signal from a transient event to assess whether the bands are random. In addition, an assessment of the envelope shape of the signal is made to confirm the signal is consistent with a rapid rise followed by a sloped decay typical of transient events. It has been found that dividing of the signal into high and low bands and analyzing each portion over a short front end portion of a transient event is effective in distinguishing glass break events from other common events.

15 Claims, 10 Drawing Sheets

GLASS BREAK SENSOR

CROSS-REFERENCE TO RELATED APPLICATIONS

This application is a continuation-in-part of application Ser. No. 08/522,716 filed Sep. 1, 1995, now U.S. Pat. No. 5,675,320 which is a continuation-in-part of International Application No. PCT/CA95/00122 filed Mar. 3, 1995.

FIELD OF THE INVENTION

The present invention relates to glass break sensors for identifying a glass break event. The invention is also directed to a method of sensing the shattering of glass.

BACKGROUND OF THE INVENTION

There are a number of existing glass break sensors which use a microphone to detect the sound energy in a monitored space and process the signal to determine if a glass break event has occurred. Many of these detectors use technology which characterizes a glass break event as having an initial signal portion, commonly referred to as a "thud", which is associated with the initial impact between the striking object and the glass surface, followed by the formation and propagation of cracks in the glass, followed by the catastrophic destruction of the glass. After this initial portion, the glass fragments continue to resonate and strike other glass fragments as they hit the floor and surroundings. This latter portion is often referred to as a secondary effect or the "tinkle" portion.

It is also known for glass break detectors to detect an initial large amplitude component (i.e. the "thud") and then look for a latter portion of the signal having many high frequency components (the "tinkle"). These high frequency components would tend to indicate the shattering of glass.

Prior art detectors continue to have problems in distinguishing glass break events from non-glass break events. Common false alarms are caused by thunder, dropping metal objects, ringing of bells, service station bells, chirping birds, slamming doors, splintering wood and mouse traps. These sound sources typically have both low frequency components and high frequency components as would a glass break event. Many of these sounds are periodic in nature and, thus, are not random.

The detection arrangement according to the present invention provides improved accuracy in predicting that a glass break event has occurred and reduces problems with respect to false alarms. This accomplished in a relatively simple manner such that the cost of the sensor is relatively low.

SUMMARY OF THE INVENTION

A glass break detector for detecting the breaking of glass according to the present invention comprises an acoustic transducer which produces a wide band electrical signal in response to receipt of sound energy of a glass break event, a processing arrangement for analysing the electrical signal of the acoustic transducer for possible detection of glass break events with the processing arrangement including means for detecting a sudden increase in the strength of the signal indicative of possible glass break event and produces an activation signal. An arrangement is provided which divides the electrical signal into a low frequency component and a high frequency component, a sampling arrangement for each of the high frequency component and low frequency component which are activated by the activation signal. Each sampling arrangement divides the respective component into a plurality of sample periods. An arrangement collectively analyzes the same periods of each component and determines whether the respective component is considered random. A signal shape detecting arrangement is also provided which analyzes the electrical signal for an envelope shape consistent with a glass break event. The device further includes an alarm signal generated which produces an alarm signal when the analysis of the electrical signal indicates each component is considered random and the envelope is consistent with the glass break event.

According to a further aspect of the invention, the arrangement for analyzing also assess whether the components demonstrate randomness concurrently for at least some of the sample periods and this criteria must be met to produce an alarm signal.

According to an aspect of the invention, the signal is analyzed over a time period of at least about 200 msec to provide each of the low band and the high band with sufficient sample periods for performing analysis thereon.

According to a further aspect of the invention, the shape detecting arrangement and the arrangement for analyzing the components are only activated after a preliminary assessment of the envelope shape and the randomness of the components is carried out. This is a very rough approximation which requires a rapid rise in the strength of the signal and some randomness of the components. Preferably, it is only carried out on a very small segment of the signal at the very beginning and the full analysis is then commenced on the remaining portion of the signal.

The present invention is also directed to a method of detecting the breaking of glass comprising using a microphone to detect sound in an area to be monitored, filtering the signal to produce a low frequency component and a high frequency component using analog to digital converters to convert both high frequency and low frequency components to a high frequency component series of bits and a low frequency series of bits, analyzing the signal to identify sudden change in the signal indicative of the transient event and, upon recognition of a transient event, analyzing the series of bits of both the high frequency component and low frequency component over a predetermined time period using sampling techniques to determine the distribution of changes in amplitude of each component and whether the distribution indicates random changes in amplitude, processing the signal to determine the envelope thereof for at least a part of said predetermined period and determining whether the signal is representative of glass break event and producing an alarm when both the high and low components indicate random changes in amplitude and the determined envelope is representative of glass break signal.

According to an aspect of the invention, the method includes considering the components for an extended time period of at least 150 msec by sampling the signal frequently and wherein each component for the time period is subdivided into small time segments having at least 10 samples and each segment is used to determine the number of times the samples of the segments change state (i.e. from high to low or low to high) and the results from the segments are used to form a distribution from which a decision whether each component is random is made.

According to a further aspect of the invention, the method includes conducting preliminary assessment after about 10 msec of a possible event being detected to eliminate signals which are clearly not of interest by testing the signal for the required initial rapid rise and randomness in the distribution of changes in the amplitude of the components.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1A:
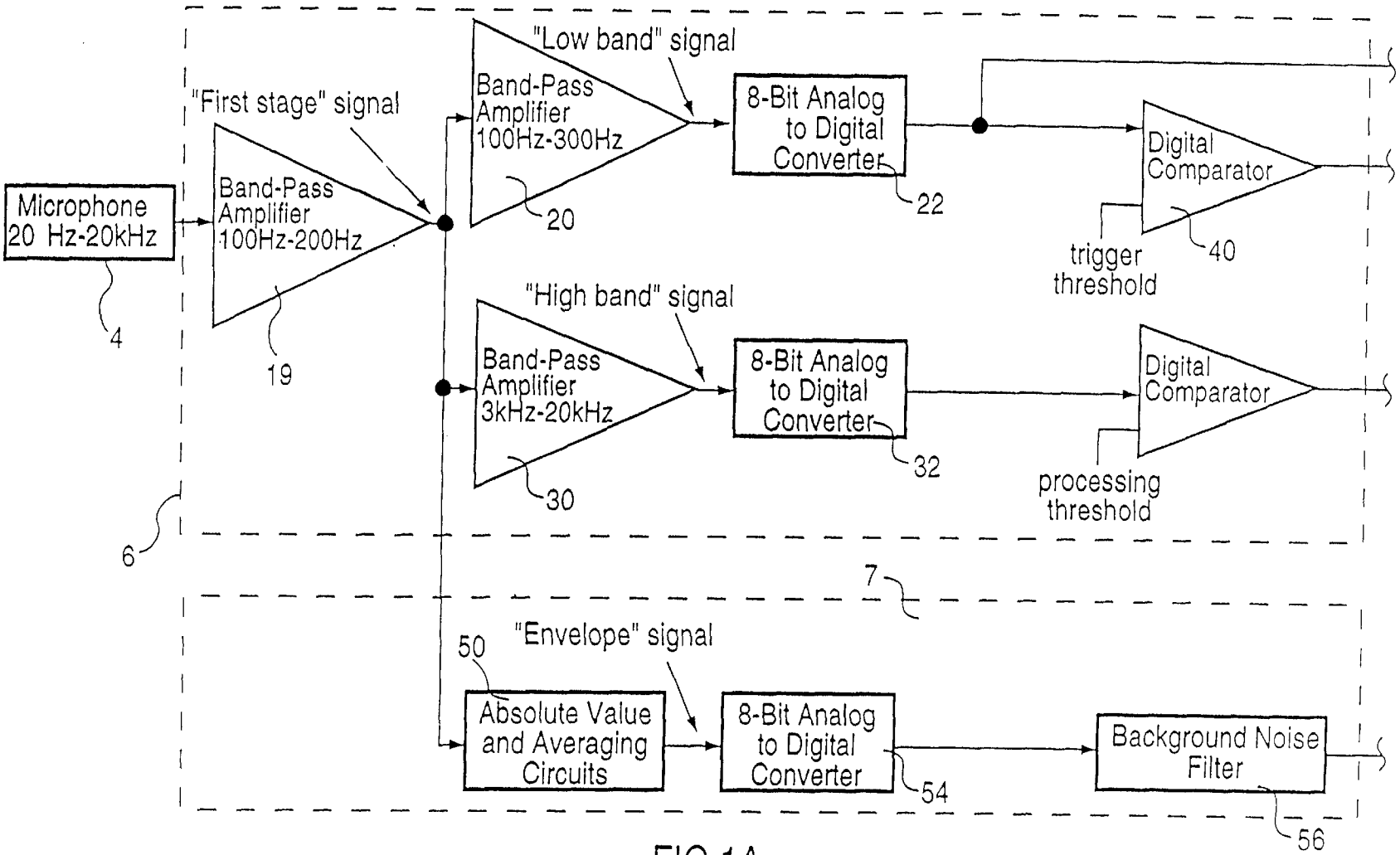
FIGS. 1A and 1B show an overview of the operations of the glass break detector.
Figure 1A:
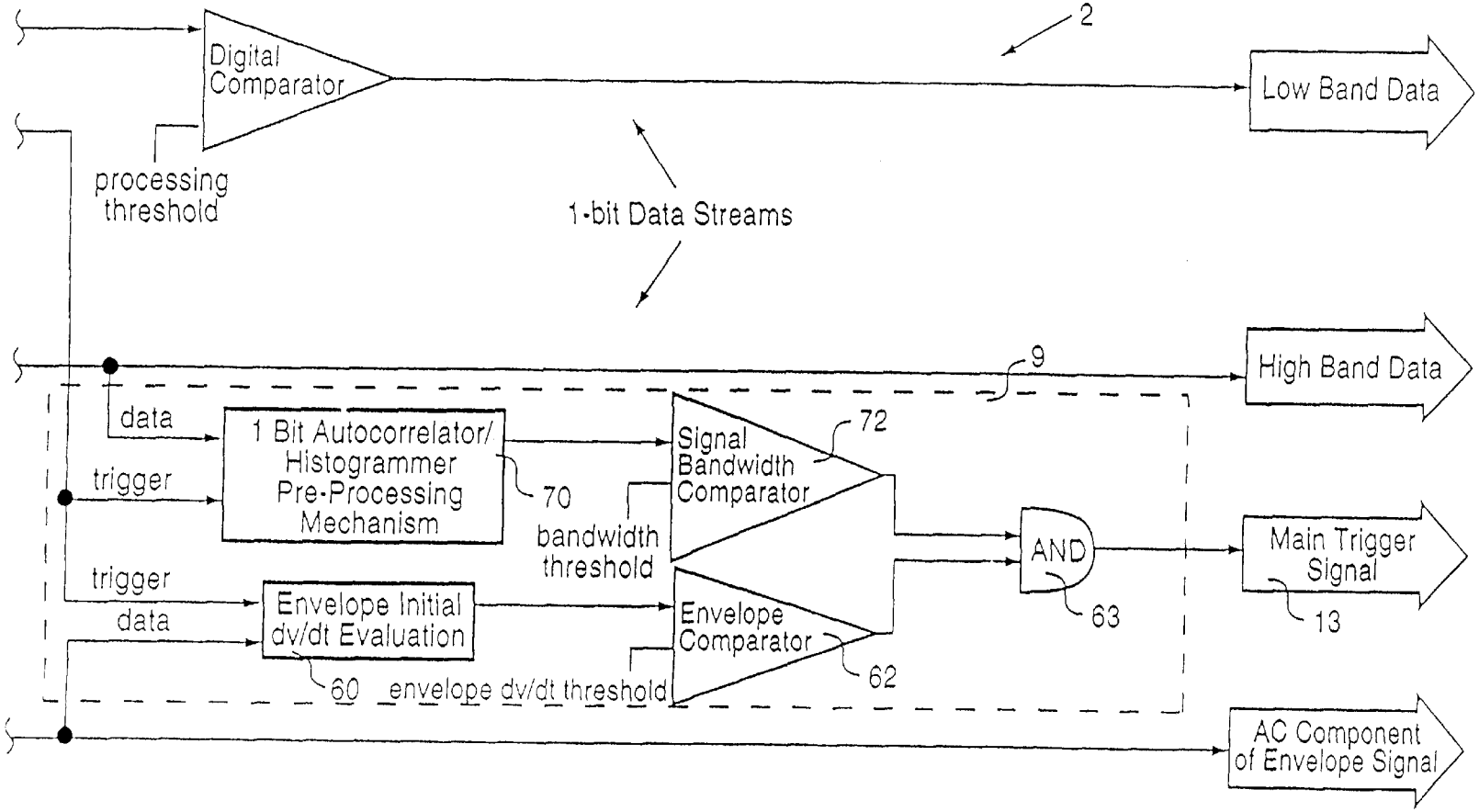
Figure 1B:
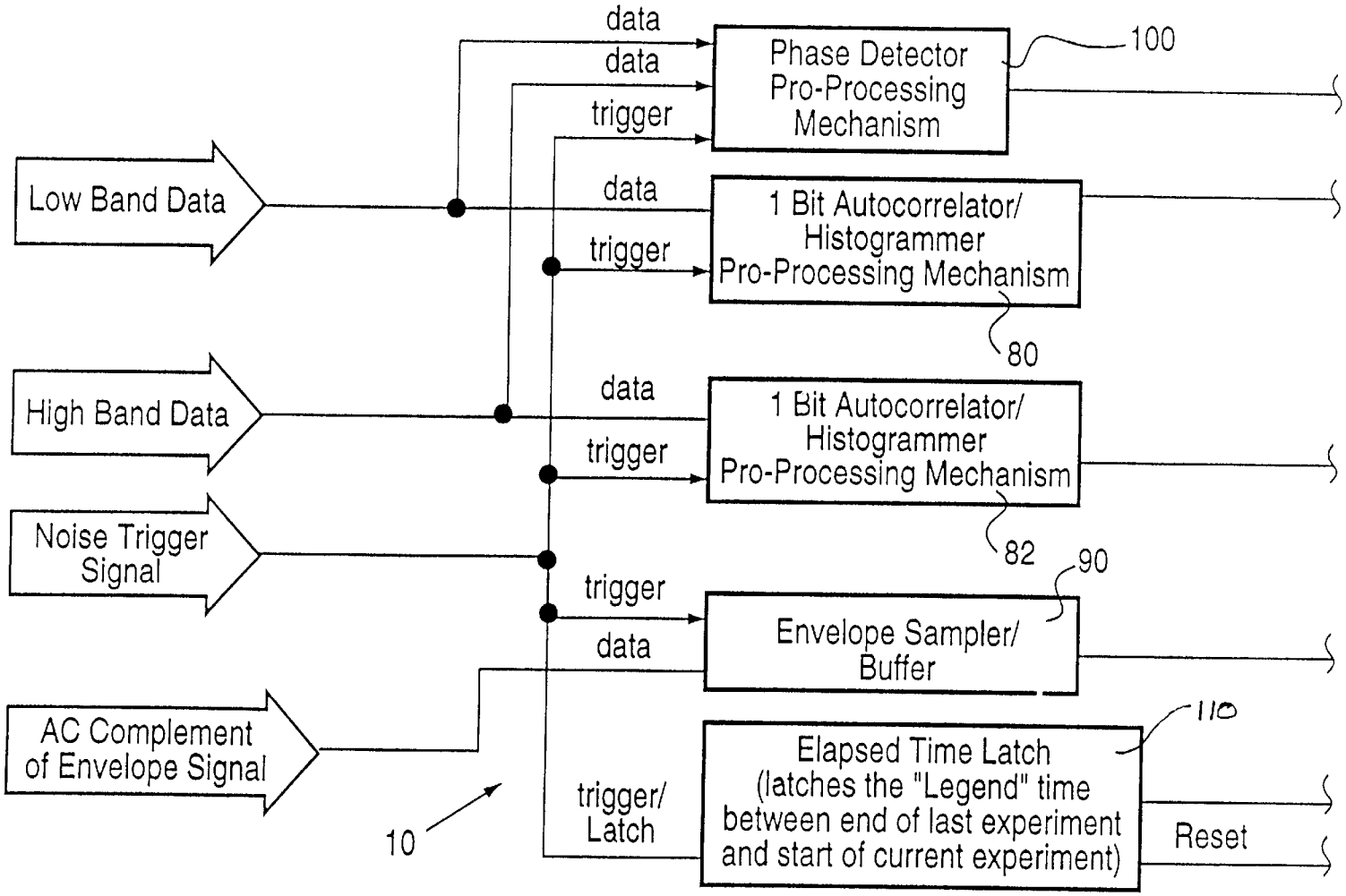
Figure 1B:
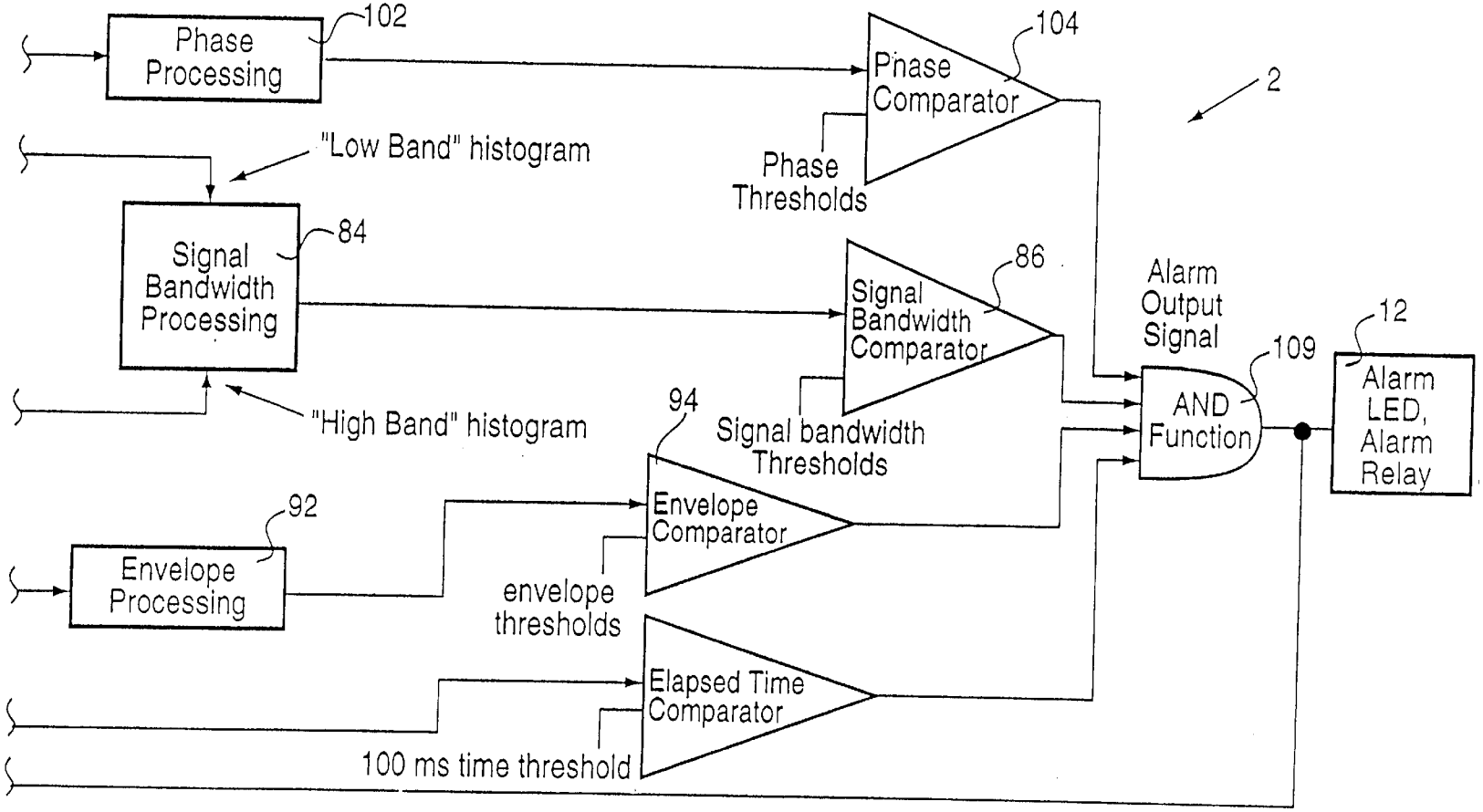

FIGS. 1A and 1B show an overview of the glass break sensor 2. The sensor uses an acoustic transducer 4 for detecting the sound of a glass break event. The sensor includes signal preparation, generally designated as 6, for processing of a high frequency component of the signal and a low frequency component of the signal. In addition, signal preparation is carried out at 7 for an envelope detector. The sensor conducts a first rough pre-evaluation at 9 of sensed signals and produces a trigger signal 13 if the rough evaluation criteria is met. Full evaluation of the signal is generally carried out at 10 as shown in FIG. 1B. If all of the requirements of the evaluation are met, an alarm output is produced at 12.

The signal from the acoustic transducer 4 is passed through a first band pass amplifier 19 having a band of 100 Hz to 20 kHz. The signal is then passed to the low band pass amplifier 20 and to the high band amplifier 30. The low band amplifier basically processes the signal between 100 Hz and 300 Hz. The high band amplifier processes the signal between 3 kHz and 20 kHz. The signals from the amplifiers are fed to respective 8 bit analog to digital converters 22 and 32, respectively. It can be seen that the converter 22 feeds the signal to the digital comparator 40, which compares the signal to a minimum threshold. Thus, a sudden large amplitude signal produced by any transient event including a glass break transient event turns the sensor on and starts the rough pre-evaluation rough evaluation takes the high band signal and processes the signal, given that the trigger 40 has been activated. The signal is processed using the one bit autocorrelator histogram preprogramming mechanism 70, which looks at the high band signal and assesses the signal for randomness and compares it with a minimum threshold at the comparator 72. At the same time, the envelope of the signal is also being evaluated. This is carried out by the envelope initial evaluation 60, which is looking for a rapid rise in the voltage of the signal. This evaluation is compared with the minimum rate of rise at 62 and the output is fed to the AND gate 63.

The trigger 40 is set relatively low such that any sudden change in the signal is detected and basically turns the sensor on. The rough evaluation carried out at 9 serves to turn the detector off if there is not a high degree of randomness in the high band portion of the signal and if the envelope does not appear to be one that could be a glass break event. The rough evaluation 9 will pass many transient events in addition to a glass break event. This rough evaluation is preferably carried out on approximately the first 10 msec of the signal. Full evaluation is not significantly affected due to the short time duration. If desired, the full evaluation can occur simultaneously and terminate if the pre-evaluation is negative. Given that the signal passes the rough evaluation at 9, the full evaluation of the signal that is carried out at 10. This full evaluation examines the low band signal for randomness at the one bit autocorrelator histogram preprocessing mechanism 80 and a similar evaluation is carried out on the high band signal by the one bit autocorrelator/histogram preprocessing mechanism 82. It has been found that these devices should evaluate the first portion of the glass break signal and are typically within about the first 250 msec of the signal. The devices 80 and 82 preprocess the low band/high band signals and produce histograms which allow the signal bandwidth processing unit 84 to make an assessment of whether each of the signals is random and thus there is a possibility that a glass break event has been detected. A minimum level is fed to the comparator 86. The exact mechanism for the histogram and the forming of the histograms by units 80 and 82 will be more fully explained later.

The sensing device also includes a phase detector preprocessing mechanism 100. It has been found that with a glass break event, both the low band and the high band signals should demonstrate randomness in the same time interval. Thus, it is not appropriate that the high band signal is initially random followed by a portion where it is not random, with the low band signal initially not random and then becomes random. For a glass break event, it has been found that both low band and high band should demonstrate randomness in the same time frame. The phase detector 100 and the phase processing 102 determine whether both high and low band signals are considered random at the same time, and if so, a positive output is produced at comparator 104.

The sensing unit also includes the envelope sampler buffer 90, the envelope processing 92 and the envelope comparator 94. Basically, the signal from the acoustic transducer 4 passes through the absolute value and averaging circuit 50, to the 8 bit analog to digital converter 54 and to the background filter 56. The background filter 56 removes the portion of the envelope signal due to average background noise so that any sudden change in the signal can be evaluated as opposed to the background noise plus that sudden change. The output from this is fed to the envelope sampler buffer 90. The envelope typically has a rapid rise followed by an exponential type decline or fall-away, and various criteria are used to determine whether a detected transient event meets this criteria.

The envelope of the signal is analyzed by the sampler and buffer 90 which samples the signal 64 times over the 250 msec. The samples provide an approximation of the sound energy. These samples are analyzed using two different criteria. The first analysis basically looks at the samples and determines the sound energy in the first 100 msec of the signal and this portion must be two times greater than the sound energy of the last 100 msec of the signal. With this analysis, there is a gap in the center of approximately 50 msec. This analysis is looking for a fairly rapid decay in the signal which would be similar to an exponential type decay found in low reverberation areas.

A second test is also carried out which is looking for a linear type deterioration, which can occur in high reverberation areas. Again, the samples are divided and analyzed. This analysis is on the last 200 msec of the signal which is broken into four equal 50 msec parts. The first part must have a sound energy greater than the second part, which must have a sound energy greater than the third part, which must have a sound energy greater than the fourth part.

The envelope detector carries out the first test by looking for the exponential type decay, and if this fails, it looks for the linear deterioration. If either of the tests are satisfied, then the envelope is considered to be appropriate.

The purpose of the envelope detector is to try to reject white or pink noise which is normally constant, but may have on occasion some decays. Although the criteria used by the envelope detector is not highly sophisticated, these tests can be carried out quickly and provide, in combination with the other analysis of the signal, satisfactory results in identifying glass break events and not creating false alarms.

By analyzing the signal for a number of different characteristics, the individual analysis of the characteristics can be relatively simple, which allows the fast processing of the signal that is desirable with the glass break detector. The different tests complement each other, and therefore, even if the simplifications are not always correct, one of the other characteristics will be affected and will result in the signal being identified as something other than a glass break.

There are also certain events which tend to be constant, but at some point will demonstrate a decay. For example, when an air conditioner comes on, it would run for a long time, however, when it shuts off, it would demonstrate a certain decay. The trigger 40 would continually cause processing of the signal, and thus, this decay portion could eventually be detected. To partially overcome this and to make sure that something which is generally constant and only occasionally transient does not cause an alarm, the sensor includes an elapsed time counter 110. This elapsed time counter accumulates elapsed time between the end of the last sensed possible signal and the start of the current sensed signal. In this way, a time delay is introduced between signals which would trigger the system. By introducing this time delay, a constant sound source is less likely to stop at a point where the envelope detection would detect its decay. It has been found that a delay of approximately 100 msec is effective while still allowing a glass break event to be recognized, should it occur. Given that all of the criteria are met (i.e. positive inputs are fed to the AND gate 109), an alarm is produced at 12.

Figure 2:
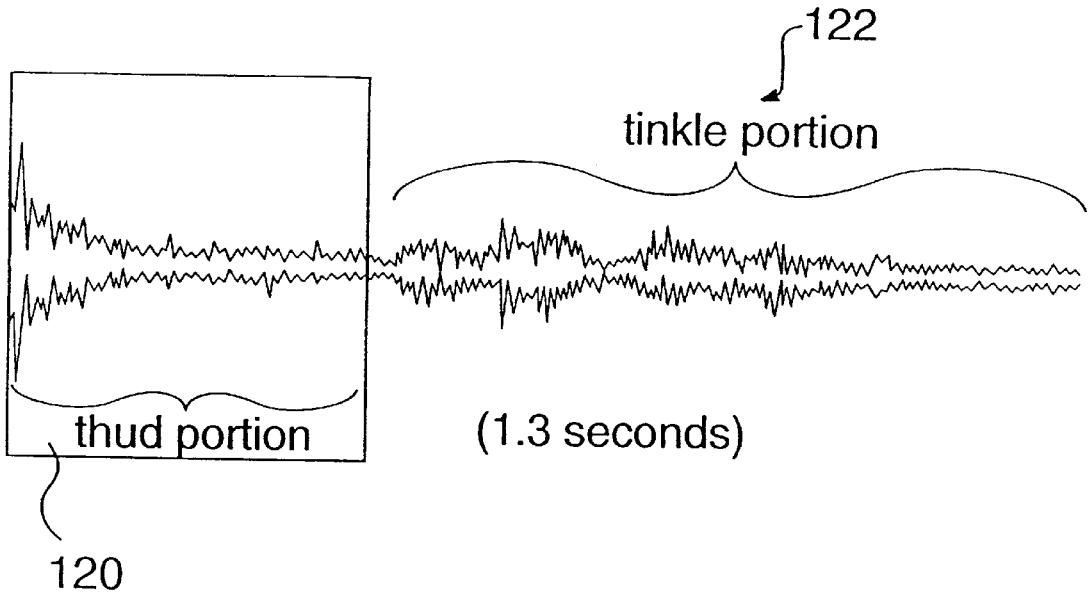
FIG. 2 is a sample glass break signal.

A typical glass break signal is shown in FIG. 2, the thud portion is shown as 120 and the tinkle portion is shown as 122. It can be seen that the tinkle portion is actually a secondary effect which occurs well after the initial thud. The thud, although commonly considered to be a low band signal, does include many high frequency components. The duration of the thud is in the order of about 300 msec, however, it has been found that it is better to evaluate the signal over the first 250 msec. By dividing this signal into a low band portion and a high band portion, the effects of the low band and the high band are separately evaluated. Each of the low band and high band is reviewed to determine whether there is randomness in the signal. It has been found that both the low band and the high band have these properties if a glass break event has occurred. Full autocorrelation on each of these signals by means of a microprocessor and an 8 bit analog to digital converter would prove very effective, however, at the present time, this is expensive to implement. It has been found that each of the low band and high band signals can be simplified to a signal represented by either 0's or 1's and the signals are evaluated in a particular manner to look for transitions (i.e. from '0' to '1' or from '1' to '0'). Basically, the signal is continually sampled for a certain time period and the number of transitions in that time period is totalled. This then provides one entry for the number of transitions at that level. The process continues to allow a histogram to be formed over the time period of approximately 250 msec (high band—128 msec, low band—175 msec).

Figure 3:
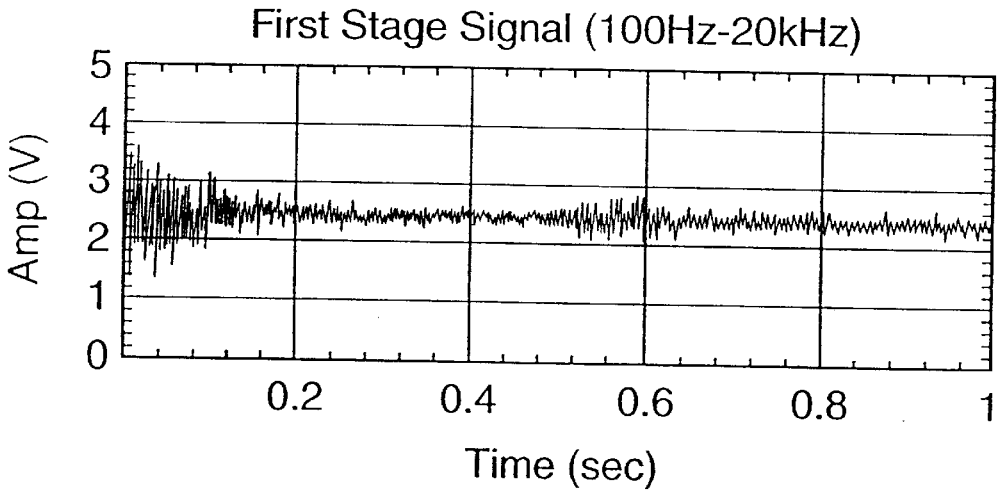
FIG. 3 is a sample glass break signal before division into low and high frequency bands.
Figure 4:
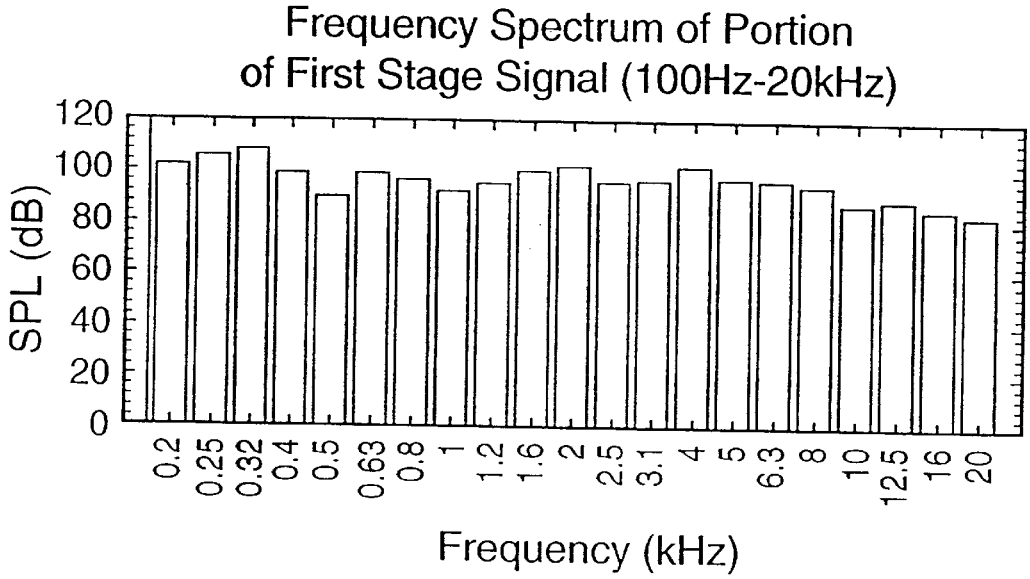
FIG. 4 is a Frequency Spectrum of a portion of the signal of FIG. 3.
Figure 5:
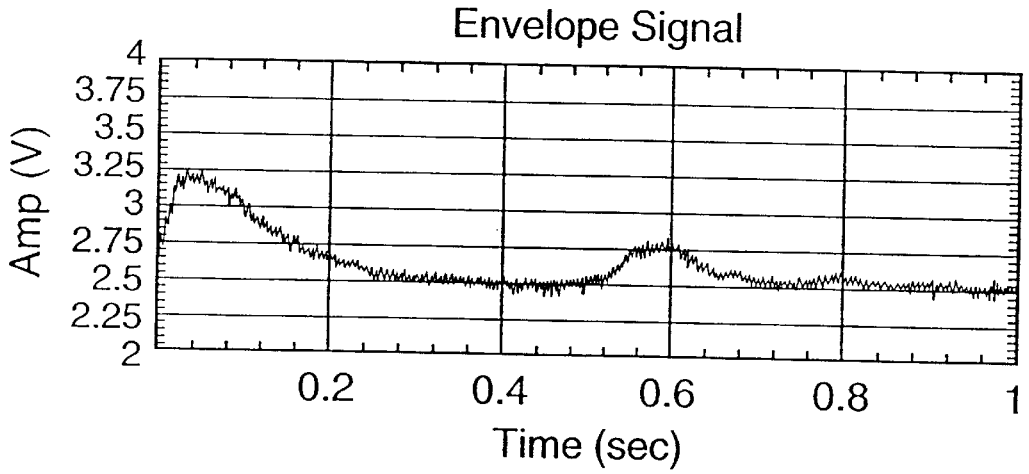
FIG. 5 is an example envelope signal.
Figure 6:
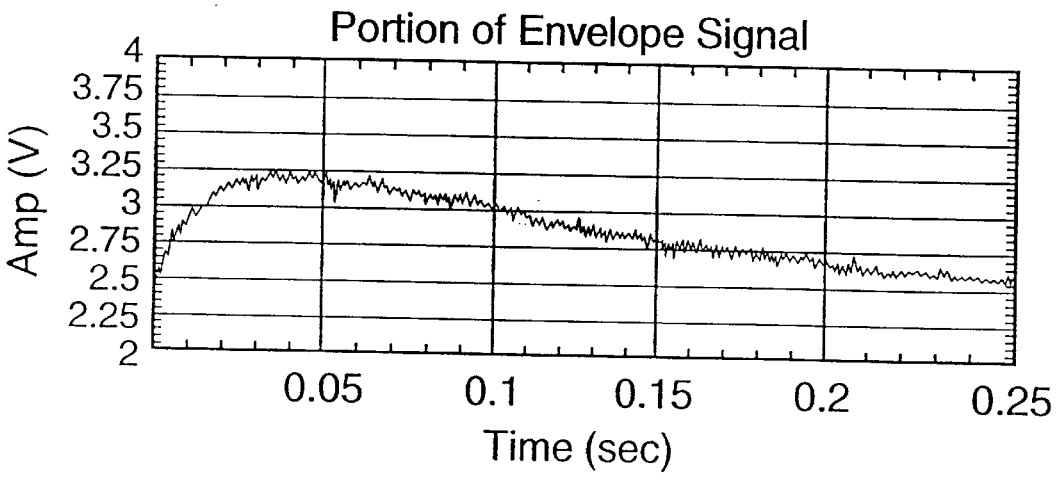
FIG. 6 is better detail of the first 250 msec of the signal of FIG. 5.
Figure 7:
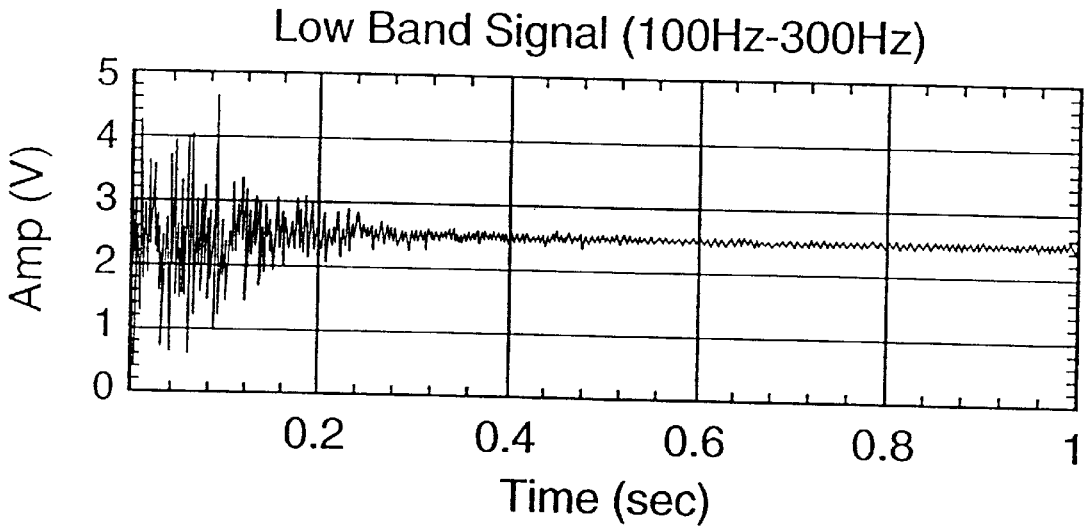
FIG. 7 is a low band signal of a glass break event (derived from original signal as shown FIG. 3)
Figure 8:
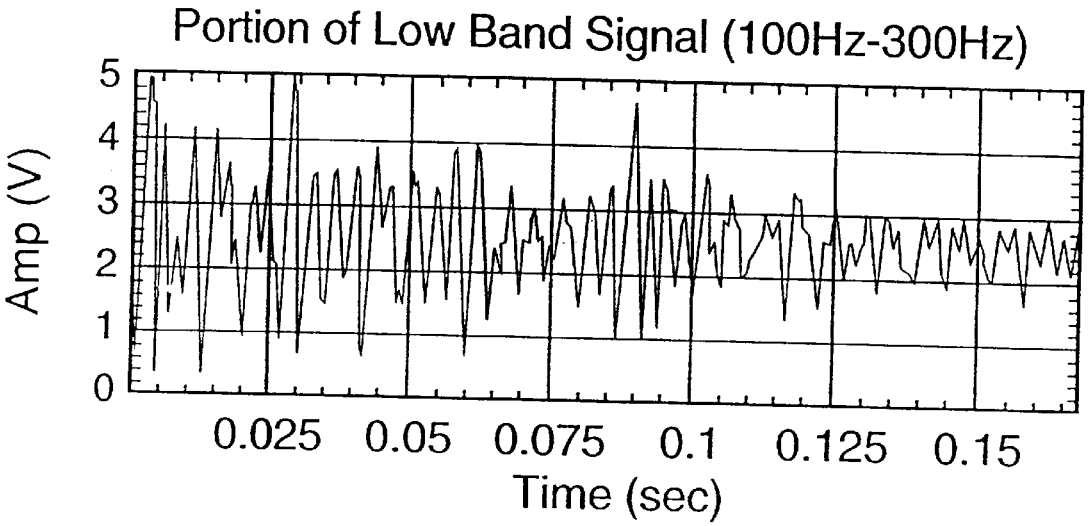
FIG. 8 shows increased detail of a portion of the signal of FIG. 7.
Figure 9:
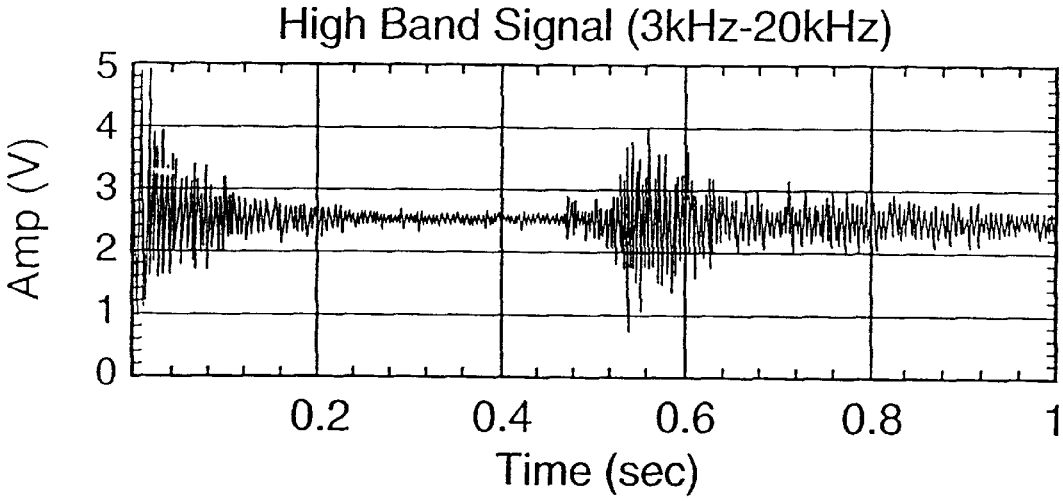
FIG. 9 is a high band portion of a glass break event (derived from original signal as shown in FIG. 3)
Figure 10:
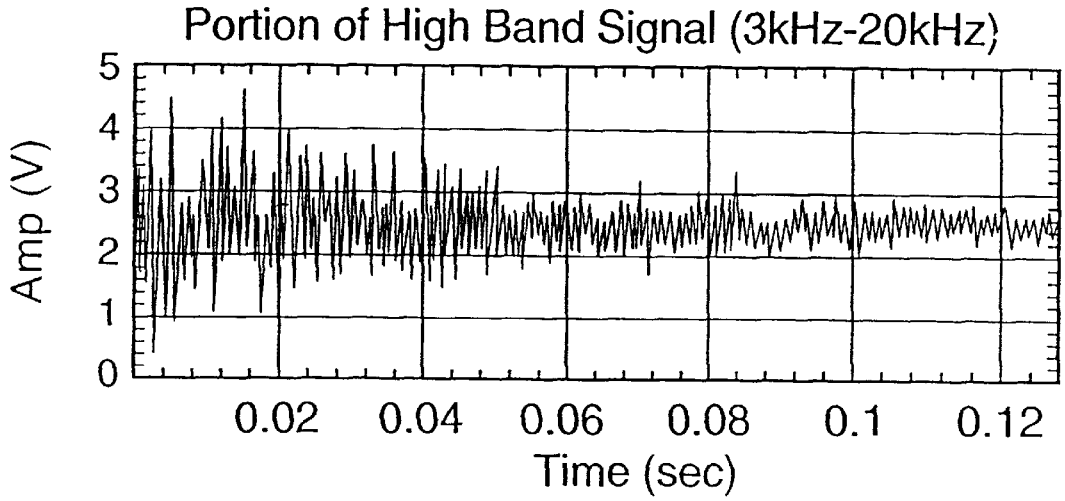
FIG. 10 shows increased detail of a portion of FIG. 9.
Figure 11:
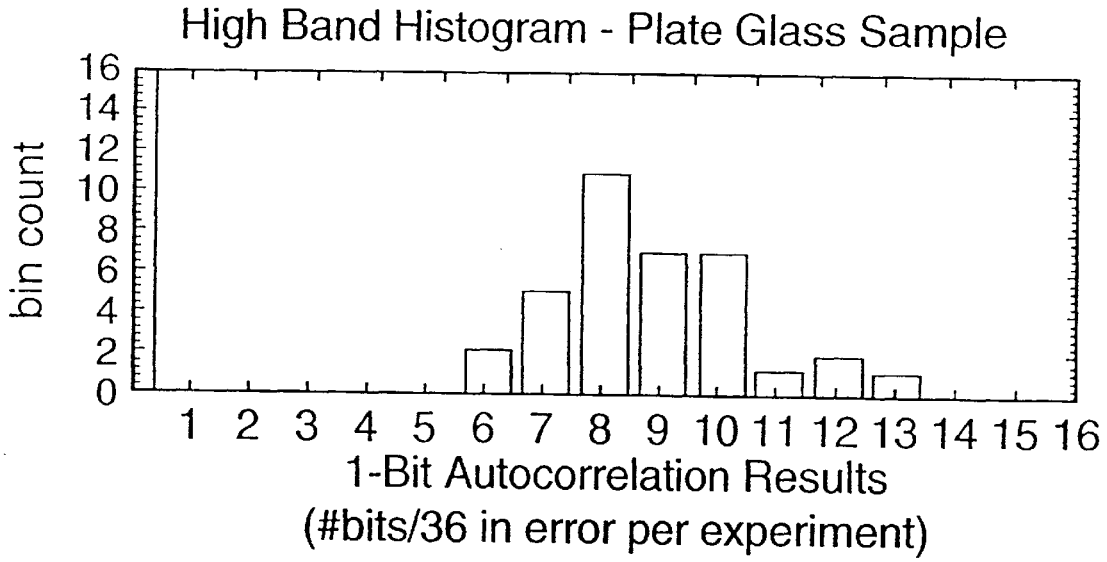
FIG. 11 shows a high band histogram.
Figure 12:
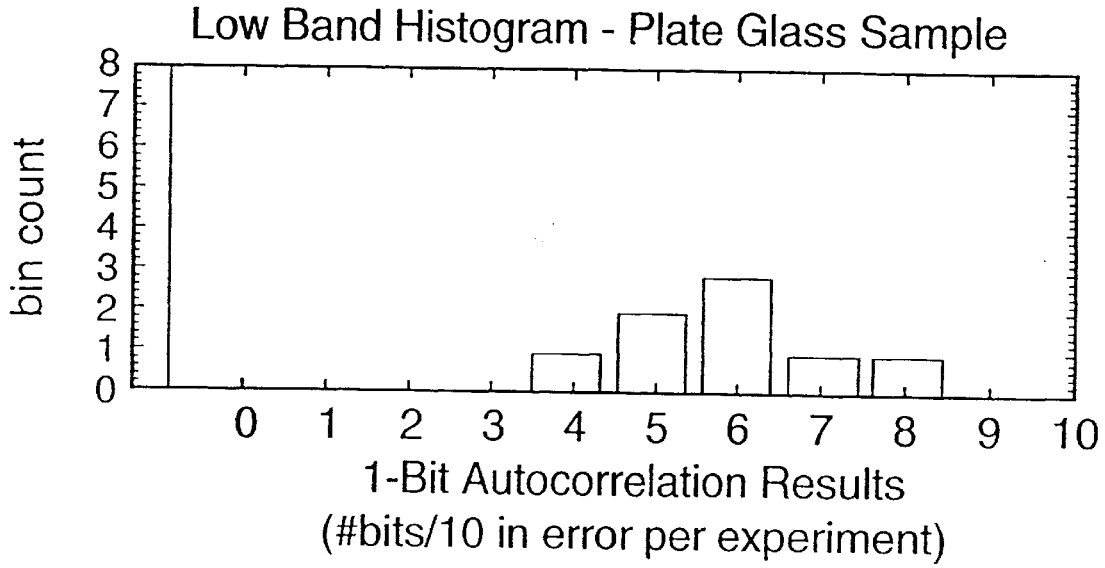
FIG. 12 shows a low band histogram.

FIG. 3 shows a glass break signal over 1 second. It can be seen that the signal over the first 250 msec has a rapid rise followed by an exponential type decay. As indicated in the frequency spectrum of FIG. 4 (relating to a portion of the first stage signal), the frequency content of the signal is widely distributed. FIG. 5 shows the envelope signal over the first second and FIG. 6 shows the first 250 msec of the envelope signal in greater detail. FIG. 7 shows the low band signal and it can be seen that the signal is very active in the first 250 msec. The first portion of the low band signal, as shown in FIG. 8, provides additional detail on the initial portion of the low band signal. FIG. 9 shows the high band signal where there is an initial portion in the first 250 msec and a secondary portion starting at approximately 500 msec. The initial portion of the high band signal for the first 120 msec is generally shown in FIG. 10. Histograms of the high band and low band signals for the plate glass sample are shown in FIGS. 11 and 12.

The one bit autocorrelation results for the high band involve sampling the 1/0 bit stream 36 times and counting the number of transitions from 0 to 1 or 1 to 0. This experiment is repeated a number of times to form the histogram. The high band processing has 36 experiments due to its rapidly changing nature. The low band processing samples the low band 1/0 bit stream 10 times, also counting transitions. This experiment is repeated 8 times to produce the low band histogram.

The above approach can be implemented using a microprocessor and the exclusive OR function of the microprocessor. The 8 bit signal for evaluation of the signal for randomness is converted to a one bit signal using a digital comparator, and thus, the signal is either a 0 or 1. The amplitude threshold setting is above the normal noise level, but is still relatively low to provide useful information in the last experiments being evaluated. This low level is possible as the analysis is initiated when a large amplitude signal is detected. It is preferred to capture the initial part of the signal, as it has been found to be more reliable and consistent. This is the reason for the very short pre-evaluation.

The invention uses a large portion of the signal in the order of about 170 msec or more to determine whether the signal source is periodic or random in nature. The signal is broken into a low band portion and a high band portion and each of these portions are sampled within the 170 msec.

The phase detector basically looks at the signals from the low band and the high band and evaluates how many simultaneous transitions have occurred. In the example described, there is a possibility of a maximum of 31 simultaneous transitions. The high and low band signals are sequentially considered and simultaneous transitions are determined by comparing the adjacent experiments. If there are at least 10 simultaneous transitions, the signals are considered in phase indicative of a random signal from a glass break event.

Returning to the formation of the histograms, the various experiments have the results tabulated and the collective results of the experiments are used to predict whether or not the signal is random.

The high band signal is analyzed for the first 128 msec by conducting 36 experiments with each experiment being approximately 1 msec in duration. The one bit signal is sampled 36 times and a form of one shift autocorrelation is carried out on the signal. This is equivalent to counting the number of transitions in the signal. The number of transitions in an experiment is used to increase the appropriate bin of the histogram one unit. The 128 msec period is sufficient time for measuring the high band signal.

The low band signal is analyzed for 170 msec by conducting 8 experiments with each experiment being approximately 20 msec in duration. The one bit signal is sampled ten times. The longer time period and the lower sampling rate is better for the lower frequency signal. The histogram is determined in the same manner as described for the high band signal.

In order to keep the costs for the sensor low, it has a single processor which uses a simplified Multi-Tasking technique for processing the signals for the high band, low band, envelope and phase.

It has been found that certain criteria can be used for predicting randomness, such as follows:

Histogram Dispersion

For the high band and low band signals to be random, there should be varying transitions and the results in the histogram should be dispersed. The unit assumes the signals are random using the following rules:

For high band histogram: Number of non-zero bins$\geqq$6

For low band histogram: Number of non-zero bins$\geqq$3

In addition, for each signal, the histogram modal bin is determined. For a random signal, the modal bin cannot be bin #0.

The cost effective sensor described above greatly simplifies the low band and high band signals and then uses sampling and statistical techniques to predict whether the signals are random. The sensor distinguishes glass break events from many common sounds. It can be appreciated that as the costs for microprocessors decrease and the sophistication of these processors and the speed thereof increase, more sophisticated assessments of the signals can be made on the fly. It should be noted that all of this processing is occurring in real time as the actual events are occurring. As the technology improves, more sophisticated techniques and assessment of randomness can be carried out and these will further improve the analysis. It should be noted that it is preferable that a glass break detector detect the breaking of different types of glass, such as annealed glass, wired glass, tempered glass and laminated glass. The actual signal produced by these different types of glass break events does vary, however, it has been found that if the first 250 msec of the glass break signal is analyzed, each of these events can be detected.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A glass break detector for detecting the breaking of glass comprising an acoustic transducer which produces a wide band electrical signal in response to receipt of sound energy of a glass break event, and a processing arrangement for analyzing the electrical signal of the acoustic transducer for possible detection of glass break events, said processing arrangement including means for detecting a sudden increase in strength of the signal indicative of a possible glass break event and producing an activation signal, an arrangement for dividing said electrical signal into a low frequency component and a high frequency component, a sampling arrangement for each of said high frequency component and said low frequency component activated by said activation signal, each sampling arrangement dividing the respective component into a plurality of sample periods, an arrangement for collectively analyzing the sample periods of each component and determining whether the respective component is considered random, a signal shape detecting arrangement which analyses said electrical signal for an envelope shape consistent with a glass break event, and an alarm signal generator which produces an alarm signal when the analysis of said electrical signal indicates each component is considered random and said envelope is consistent with a glass break event.

2. A glass break detector as claimed in claim 1 wherein said arrangement for analysing also assesses whether the components demonstrated randomness concurrently for at least some of the sample periods and said alarm signal generator additionally requires demonstrated concurrent randomness of said components to produce an alarm signal.

3. A glass break detector as claimed in claim 1 including having sufficient sample periods to analyze said signal for a time period of at least 250 msec.

4. A glass break event as claimed in claim 1 wherein said shape detection arrangement and said arrangement for analysing said components conducts a preliminary assessment of the envelope shape of said signal and the randomness of said components and only continues if the preliminary assessment confirms a rapid rise in the strength of the signal and some randomness of said components.

5. A glass break detector as claimed in claim 4 wherein said preliminary assessment uses about 10 msec of the wide band electrical signal.

6. A glass break detector as claimed in claim 4 wherein said preliminary assessment considers only said high frequency component to assess randomness.

7. A glass break detector as claimed in claim 4 including a delay means which introduces a minimum time delay period between activation signals.

8. A glass break detector as claimed in claim 7 wherein said minimum time delay is about 100 msec.

9. A glass break detector as claimed in claim 1 wherein said signal is assessed for a time period of at least 250 msec before an alarm signal can be produced.

10. A glass break detector as claimed in claim 1 wherein the sampling arrangement for the low frequency component has a lower sampling rate than the sampling rate used with respect to the high frequency component.

11. A glass break detector as claimed in claim 10 wherein the rate of sampling the high frequency component is at least three times the sampling rate of the low frequency component.

12. A method of detecting the breaking of glass comprising using a microphone to detect sound in an area to be monitored and produce a signal, filtering said signal to produce a low frequency component and a high frequency component, using analog to digital converters to convert both the high frequency and low frequency components to a high frequency component series of bits and a low frequency series of bits, analysing said signal to identify a sudden change in the signal indicative of a transient event, upon recognition of a transient event 1) analysing said series of bits of both the high frequency component and the low frequency component over a predetermined time period using sampling techniques to determine distribution of changes in amplitude of each component and whether the distribution indicates random changes in amplitude, 2) processing said signal to determine the envelope thereof over at least part of said predetermined period and determining whether the signal is representative of a glass break signal, and 3) producing an alarm when both the high and low components indicate random changes in amplitude, and the determined envelope is representative of a glass break signal.

13. A method as claimed in claim 12 including the step of assessing whether the high frequency and low frequency component demonstrate randomness concurrently for at least some of the sample periods and only producing an alarm when concurrent randomness is also found.

14. A method as claimed in claim 13 wherein said sampling techniques include considering said components for an extended time period of about 150 msec and wherein said low frequency component for the time period is subdivided into 8 segments having at least 10 samples, and each high frequency component for the time period is subdivided into 10 segments having at least 10 samples; using each segment to determine the number of times the samples of the segment change from a high to low level or low to high level, and the results from the segments are used to form a distribution from which a decision of whether each component is random is made.

15. A method as claimed in claim 13 including conducting a preliminary assessment using about 10 msec of the signal following a sudden change in the signal indicative of a transient event, said preliminary assessment eliminating signals which are clearly not of interest by testing the signal for the required initial rapid rise and for randomness in the distribution of changes in amplitude of the components.

* * * * *